United States Patent [19]

Ostrem

[11] 3,986,631

[45] Oct. 19, 1976

[54] NESTED TAB SAFETY CLOSURE

[75] Inventor: Obert M. Ostrem, Westmont, Ill.

[73] Assignee: The Continental Group, Inc., New York, N.Y.

[22] Filed: July 14, 1975

[21] Appl. No.: 595,658

[52] U.S. Cl. ..... 220/270

[51] Int. Cl.[2] ..... B65D 41/32

[58] Field of Search ..... 220/270–273, 220/94 R, 277; 215/100 A

[56] References Cited

UNITED STATES PATENTS

| | | | |
|---|---|---|---|
| 3,715,051 | 2/1973 | Hanke | 220/273 |
| 3,880,318 | 4/1975 | Fraze | 220/273 |

*Primary Examiner*—George T. Hall

*Attorney, Agent, or Firm*—John J. Kowalik; Joseph E. Kerwin; William A. Dittmann

[57] ABSTRACT

An improved child-resistant self-opening end closure wherein the finger ring portion of the pull tab is nested between two concentric curved protrusions, formed in the end panel, which obstruct access to the ring and prevent grasping and lifting of the tab. To open the closure, an upwardly tilted nose portion of the tab is depressed, thereby causing the ring portion to tilt upwardly to a point whereat it may be grasped. The additional operation, which runs counter to a child's prior experience, renders removal of the closure beyond the capability of a young child.

11 Claims, 3 Drawing Figures

NESTED TAB SAFETY CLOSURE

SUMMARY OF THE INVENTION

It is well known that the accumulation of household chemicals commonly found in the home poses the threat of death or serious injury to small children. Storage of these materials in places supposedly beyond the reach of such children has not proven wholly satisfactory. It is, therefore, one of the important objects of the present invention to provide an improved safety or security closure for an easy-open container which may be readily removed by an adult but which will frustrate efforts of small children to open the container.

It is a further object to provide an improved security closure wherein the standard easy-open closure may be employed with a minimum of modification thereto and wherein no additional parts are required. Specifically, the standard closure is modified by the addition of a plurality of protrusion formed in the end panel and by reforming of the pull tab such that the nose portion thereof is tilted upwardly.

BRIEF DESCRIPTION OF THE DRAWINGS

The various features and advantages of the security closure of this invention will be more apparent from the following detailed description when considered in connection with the accompanying drawing wherein.

DESCRIPTION OF THE PREFERRED EMBODIMENT

Figure 1:
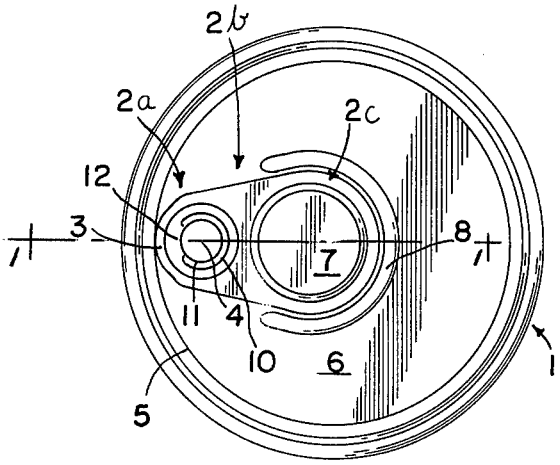
FIG. 1 is a top plane view of the improved safety closure of the present invention.

As shown in the drawings, the security closure of this invention includes an end panel 1, a pull tab 2 comprising a nose portion 2*a*, an intermediate portion 2*b* and a substantially circular finger ring portion 2*c*, an integral piercing member 3 formed in the nose portion 2*a*, a rivet 4 fastening the pull tab 2 intermediate its ends to the end panel and an opening score 5 formed in the end panel 1 and therein defining an opening flap 6.

A substantially horseshoe-shaped slit 10 is formed in the intermediate portion 2*b*, embracing the rivet 4, defining a rivet panel 11 in said portion 2*b*. The rivet panel 11 is joined to the remainder of the intermediate portion 2*c* of the tab 2 by an unslit area 12.

In the standard easy-open closure, opening is accomplished by grasping and vertically displacing the pull tab 2, thereby pivoting said pull tab 2 about the rivet 4 and impressing a downward force on the piercing member 3, said force resulting in the fracturing of the end panel 1 along the opening score 5 beneath the piercing member 3. Continued upward displacement of the pull tab 2 results in controlled tearing of the end panel 1 along the opening score 5. The opening flap 6 defined by said score 5 is then removed by pulling the pull tab 2, thereby causing further tearing along the opening score 5 until the opening flap 6 separates from the remainder of the end panel 1.

In the security closure of this invention, the finger ring portion 2*c* of the pull tab 2 is nested between two concentric curved protrusions 7 and 8, formed in the end panel 1, which closely conform with and obstruct access to the ring 2*c* and prevent grasping and lifting of the tab 2. The inner protrusion 7, which is frusto-conical in shape, is interior to the ring portion 2*c* and abuts the inner periphery of the ring 2*c* along its entire circumference. The outer protrusion 8 which comprises sloped sides 8*a* and a substantially flat, horizontal top 8*b*, is exterior to the ring portion 2*c* and abuts the outer periphery of the ring 2*c* along the entire outer periphery of the ring 2*c*. Both of the protrusions 7 and 8 extend beyond the principal plane of the tab 2 about the ring portion 2*c*.

The nose portion 2*a* of the pull tab 2 is tilted upwardly at the junction 9 with the intermediate portion 2*b* immediately radially outward of the rivet 4.

Figure 2:
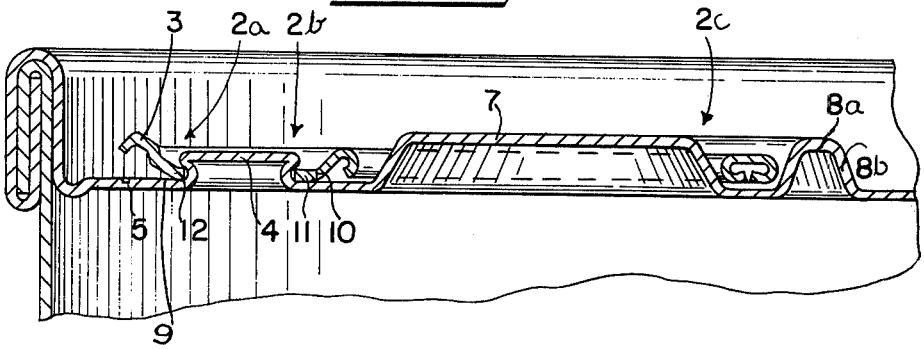
FIG. 2 is a cross-sectional view taken substantially along line 1—1 of FIG. 1.
Figure 3:
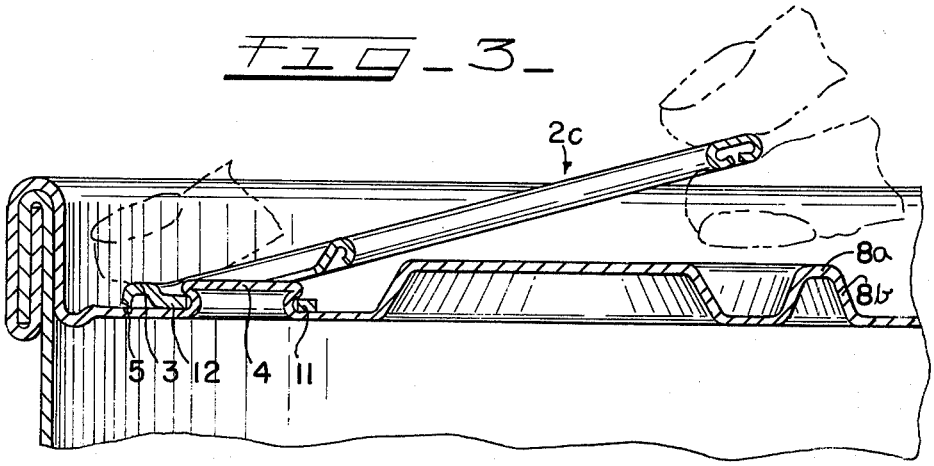
FIG. 3 is a cross-sectional view showing the tab nose portion held in the depressed position and the finger ring exposed.

To open the closure, the upwardly tilted nose portion 2*a* is depressed, causing the tab 2 to tilt about the junction 9, thereby producing an upward displacement of the finger ring 2*c* and a flexure of the unslit area 12 of the rivet panel 11. The ring 2*c* may now be grasped and the closure may be opened in the conventional manner as described hereinabove. If the nose portion 2*a* is released prior to grasping the ring portion 2*c*, the counter-rotational force exerted on the tab 2 by the unslit area 12 causes the tab 2 to resume its nested position (FIGS. 1 and 2). It is, therefore, necessary that the operations required for opening the closure be performed in the proper sequence. This additional operation, which runs counter to a child's prior experience, and which must be coordinated with the conventional opening operations, renders removal of the closure beyond the capability of a young child.

I claim:

1. An improved child-resistant safety closure for a can or similar container comprising an end panel having a score defining an opening flap therein and a pull tab secured to said end panel and having means for fracturing said score to open said flap, said pull tab comprising a nose portion and a finger ring portion; the improvement comprising shielding means on said end panel about said tab to prevent grasping said finger ring portion, and digitally operable means on said tab and said end panel for displacing said finger ring portion to an unshielded position whereat it may be grasped, thereby permitting opening of said container, said finger ring portion having an inner and an outer periphery and said shielding means comprising spaced protrusions on said end panel closely embracing said inner and outer peripheries of said finger ring portion and preventing finger contact with either periphery of said finger ring portion.

2. The invention according to claim 1, wherein said protrusions extend beyond the principal plane of said pull tab.

3. The invention according to claim 2, wherein said shielding means comprises a circular protrusion concentric with and interior to said finger ring portion of said pull tab and a curved protrusion concentric with and exterior to said finger ring portion, said protrusions defining a tab-nesting channel therebetween and said finger ring portion closely fitting into said channel.

4. The invention according to claim 3, wherein said displacement means comprises said nose portion of said pull tab inclined relative to the principal plane of said pull tab whereby application of a panelward force to said nose portion causes tilting of said pull tab, resulting in withdrawal of said finger ring portion from said channel and thereby permitting grasping of said finger ring portion and opening of said container.

5. The invention according to claim 4, wherein said tilting of said pull tab flexes a portion of said tab, said portion exerting a counter-rotational force on said pull tab and biasing said pull tab in a direction urging said finger ring portion into said channel.

6. The invention according to claim 5, wherein said circular protrusion is frusto-conical in shape.

7. The invention according to claim 6, wherein said curved protrusion comprises sloped sides and a substantially flat horizontal top.

8. The invention according to claim 7, wherein said channel comprises two sloped sides and a substantially flat horizontal bottom, with said finger ring portion of said tab resting on said bottom.

9. The invention according to claim 8, wherein said bottom of said channel lies in the plane of said end panel.

10. An improved safety-closure comprising a closure member, a rigid tab having a handle portion, shielding means on said closure member about said tab to prevent grasping said handle portion, means tiltably mounting said tab on said closure, said tab having means displaceable with respect to said closure member for tilting said tab, thereby displacing said handle portion to an unshielded position adaptable for grasping thereof by the user, said shielding means comprising protrusions formed on said closure member closely embracing the periphery of said handle portion and preventing finger contact therewith.

11. The invention according to claim 10, wherein said tab includes a nose portion opposite said handle portion, said nose portion being formed at an angle to the principal plane of said tab whereby a panelward displacement of said nose portion tilts said tab, thereby displacing said handle portion to an unshielded position.

* * * * *